US011400468B2

(12) United States Patent
Ou et al.

(10) Patent No.: US 11,400,468 B2
(45) Date of Patent: Aug. 2, 2022

(54) GAS-LIQUID TWO-PHASE FLOW ATOMIZING NOZZLE

(71) Applicant: Jiangsu University, Jiangsu (CN)

(72) Inventors: Mingxiong Ou, Jiangsu (CN); Shuai Zang, Jiangsu (CN); Chuan Zhang, Jiangsu (CN); Weidong Jia, Jiangsu (CN); Huitao Zhou, Jiangsu (CN)

(73) Assignee: Jiangsu University, Jiangsu (CN)

( * ) Notice: Subject to any disclaimer, the term of this patent is extended or adjusted under 35 U.S.C. 154(b) by 0 days.

(21) Appl. No.: 17/263,902

(22) PCT Filed: Jul. 30, 2019

(86) PCT No.: PCT/CN2019/098342
§ 371 (c)(1),
(2) Date: Jan. 28, 2021

(87) PCT Pub. No.: WO2020/134068
PCT Pub. Date: Jul. 2, 2020

(65) Prior Publication Data

US 2021/0323009 A1 Oct. 21, 2021

(30) Foreign Application Priority Data

Dec. 25, 2018 (CN) ..... 201811587903.9

(51) Int. Cl.
*B05B 7/04* (2006.01)

(52) U.S. Cl.
CPC ..... *B05B 7/0425* (2013.01); *B05B 7/0458* (2013.01)

(58) Field of Classification Search
CPC ... B05B 7/0425; B05B 7/0458; B05B 7/0815; B05B 7/0466
USPC ..... 239/425, 425.5
See application file for complete search history.

(56) References Cited

U.S. PATENT DOCUMENTS 3,508,339 A * 4/1970 Debacher ..... B01D 1/18 34/368
3,897,004 A * 7/1975 French ..... B05B 7/0425 239/344
4,103,827 A * 8/1978 Kumazawa ..... B05B 17/0692 239/8

(Continued)

FOREIGN PATENT DOCUMENTS

CN 1206043 6/2005
CN 1298434 2/2007

(Continued)

OTHER PUBLICATIONS

"International Search Report (Form PCT/ISA/210) of PCT/CN2019/098342," dated Nov. 1, 2019, with English translation thereof, pp. 1-4.

*Primary Examiner* — Chee-Chong Lee
*Assistant Examiner* — Kevin Edward Schwartz
(74) *Attorney, Agent, or Firm* — JCIP Global Inc.

(57) ABSTRACT

A gas-liquid two-phase flow atomizing nozzle includes a nozzle core, an outer sleeve, and an atomizing body. An inner cavity of the nozzle core consists of an inlet tapered section, a jet flow section, and an outlet diffusion section. The outlet diffusion section of the nozzle core is connected to an atomizing body mixing chamber. The jet flow section of the nozzle core is in communication with external atmosphere through a core air inlet hole, an air inlet buffering chamber, and a sleeve air inlet hole.

3 Claims, 4 Drawing Sheets

(56) References Cited

U.S. PATENT DOCUMENTS

| | | | | |
|---|---|---|---|---|
| 4,209,912 | A | 7/1980 | Barker | |
| 5,297,542 | A * | 3/1994 | Bacon | A61M 15/0093 128/200.14 |
| 7,036,753 | B2 * | 5/2006 | Huffman | B05B 7/0466 239/427 |
| 7,108,203 | B2 * | 9/2006 | Huffman | B05B 7/0475 239/427 |
| 7,284,713 | B2 * | 10/2007 | Geser | A61M 11/00 239/419 |
| 7,472,843 | B2 * | 1/2009 | Pearson | B05B 15/658 239/428.5 |
| 9,447,796 | B2 * | 9/2016 | Han | B05B 1/3415 |
| 10,766,044 | B2 * | 9/2020 | Yi | B05B 11/06 |
| 11,027,295 | B2 * | 6/2021 | Gunn | B05B 15/55 |
| 2017/0241710 | A1 * | 8/2017 | Hogan | B01D 1/20 |
| 2020/0147624 | A1 * | 5/2020 | Hamaura | B01F 3/04063 |

FOREIGN PATENT DOCUMENTS

| | | |
|---|---|---|
| CN | 101005902 | 7/2007 |
| CN | 100571890 | 12/2009 |
| CN | 102705272 | 10/2012 |
| CN | 203170476 | 9/2013 |
| CN | 103769324 | 8/2015 |
| CN | 206168605 | 5/2017 |
| CN | 104815773 | 9/2017 |
| CN | 109909086 | 6/2019 |

* cited by examiner

GAS-LIQUID TWO-PHASE FLOW ATOMIZING NOZZLE

BACKGROUND

Technical Field

The present invention relates to a gas-liquid two-phase flow atomizing nozzle, and specifically to structural features of an internal mix gas-liquid two-phase flow atomizing nozzle. The nozzle is applicable to the field of pesticide spraying and application using plant-protection machinery in orchards and facility agriculture.

Description of Related Art

In the technical field of pesticide spraying and application using plant-protection machinery in agriculture, gas-liquid two-phase flow atomizing nozzles are widely applied to the spraying of various chemical pesticides. A pesticide liquid is atomized by the gas-liquid two-phase flow atomizing nozzle into fine spray droplets to be sprayed on the plant surface. At present, there are mainly three types of gas-liquid two-phase flow atomizing nozzles: internal mix type, external mix type, and internal-external mix type. For internal mix nozzles, liquid and gas form a gas-liquid two-phase flow inside the chamber of the nozzle, which is atomized at the outlet of the nozzle. Depending on different internal structures of nozzles, some internal mix nozzles have the characteristics of a small spray flow rate, a large droplet size, and anti-drifting, and some internal mix nozzles have the characteristics of a small spray flow rate, a small droplet size, and being prone to drifting. External mix nozzles are nozzles that use high-pressure gas to assist in atomization, where high-pressure gas drives spray droplets to undergo complicated processes such as acceleration, collision, merging, and breakup in the outer space of the outlet of the nozzle; and have the characteristics of a good atomizing effect, a small droplet size, and a long spraying distance. However, external mix nozzles need to be equipped with a liquid pressurizing and air pressurizing means, resulting in a complicated spraying system with high costs, and small-diameter droplets are likely to cause drifting, loss, and phytotoxicity. Internal-external mix nozzles are a type of gas-liquid two-phase flow atomizing nozzle having both an internal mix structure and an external mix structure, and have the characteristics of a small spray flow rate, a good atomizing effect, a small droplet size, and a long spraying distance. However, similar to external mix nozzles, internal-external mix nozzles also need to be equipped with a liquid pressurizing and air pressurizing means, resulting in a complicated spraying system with high costs, and are likely to cause drifting, loss, and phytotoxicity.

To reduce the usage amount of chemical pesticides, gas-liquid two-phase flow atomizing nozzles with small spray flow rate and large droplet size are designed and developed, so as to reduce the amount of pesticide applied, improve the adhesion property of the pesticide liquid, and reduce drifting, thereby achieving a better effect with less chemical pesticide. However, the existing patented technologies still have the following problems. 1. Gas-liquid two-phase flow atomizing nozzles currently used in the plant-protection machinery field are all for enhancing the atomizing effect, and the small droplet size and long spraying distance are likely to cause pesticide drifting, loss, and phytotoxicity. There is no patented technological achievement or literature in the area of design and development of nozzles with large droplet size and small spray flow rate by using the gas-liquid two-phase flow technique to suppress the atomizing effect of the nozzle. 2. Existing patented technologies related to the gas-liquid two-phase flow fail to establish a relational expression between the spray droplet size of the nozzle, the spray flow rate, the spray medium characteristics and geometrical dimension parameters of the nozzle, and lack methods for designing and controlling the droplet size. Existing relevant patented technologies mainly describe the constituents, structural features, and flow path shape of the nozzle, and provide some structural solutions, but cannot provide technical support for the specific dimension design of the nozzle for nozzle products with detailed design conditions regarding the volume median diameter of spray droplets, the designed spray flow rate, and the medium characteristics.

The present invention provides a gas-liquid two-phase flow atomizing nozzle and a design method therefor. The nozzle is based on the pressure atomization principle of the gas-liquid two-phase flow, where liquid flows at high speed in the jet flow section of the nozzle to cause a significant pressure drop so that a pressure difference is formed between the external atmospheric pressure and the liquid pressure inside the jet flow section, and driven by the pressure difference, air flows through the sleeve air inlet hole of the nozzle, the air inlet buffering chamber and the nozzle core air inlet hole and enters the jet flow section to mix with the liquid inside the jet flow section, and the gas-liquid two-phase flow is finally pressure-atomized by the atomizing-body outlet. The nozzle has the characteristics of a small spray flow rate and a large droplet size, is applicable to the field of pesticide spraying and application using plant-protection machinery in agriculture, and can effectively reduce a usage amount of pesticide and improve a pesticide utilization rate, an adhesion property, and an anti-drifting performance. The present invention not only provides a structure of a gas-liquid two-phase flow atomizing nozzle, but also establishes a relational expression between parameters such as the volume median diameter $D_{0.5}$ of spray droplets of the nozzle, the designed spray flow rate Q and geometrical dimensions of the nozzle, provides design principles for the diameter $d_1$ of the nozzle core air inlet hole, the diameter $d_2$ of the atomizing-body outlet and the diameter $d_3$ of the sleeve air inlet hole, and provides design formulas of the diameter $D_1$ of the jet flow section, the length $L_1$ of the jet flow section, the diffusion angle β of the outlet diffusion section, the maximum inner diameter $D_2$ of the atomizing body mixing chamber and the width b of the air inlet buffering chamber.

Chinese Patent Application No. 01111963.2 discloses an air assisted spray nozzle assembly having an improved air cap. The nozzle assembly has both an internal mix structure and an external mix structure, where external pressurized air is introduced into the air passages inside the air cap to achieve both internal and external mixing to enhance the atomizing effect. This patent provides a detailed description of the structural features of the nozzle body, the liquid passages and the air cap, and can be used for producing a large number of fine spray droplets to facilitate the rapid evaporation of the liquid.

Compared with the above patent, in the present invention, air in the external atmospheric environment under natural conditions is mixed with the liquid inside the nozzle, no pressurized air source is needed during the operation of the nozzle, and air is drawn into the nozzle only by means of the external atmospheric pressure and the pressure drop resulting from the liquid flowing in the nozzle. The components and structure of the nozzle of the present invention are greatly different from those of the above patent. In addition, the nozzle designed by the present invention has the characteristics of a small spray flow rate and a large droplet size, while the nozzle provided by the above patent has the characteristic of small spray droplets, so there is a significant difference between the structure and atomization objective of the nozzle of the present invention and those of the above patent. In addition, the present invention not only provides a structure of a gas-liquid two-phase flow atomizing nozzle, but also establishes a relational expression between parameters such as the volume median diameter $D_{0.5}$ of spray droplets of the nozzle, the designed spray flow rate Q and geometrical dimensions of the nozzle, provides design principles for the diameter $d_1$ of the nozzle core air inlet hole, the diameter $d_2$ of the atomizing-body outlet and the diameter $d_3$ of the sleeve air inlet hole, and provides design formulas of the diameter $D_1$ of the jet flow section, the length $L_1$ of the jet flow section, the diffusion angle β of the outlet diffusion section, the maximum inner diameter $D_2$ of the atomizing body mixing chamber and the width b of the air inlet buffering chamber.

Chinese Patent Application No. 03810334.6 discloses an internal mix air atomizing spray nozzle assembly. This patent provides a nozzle assembly having an internal gas-liquid mix and fluid impact structure. The nozzle mixes external pressurized air with liquid to generate a two-phase flow, which is formed into spray droplets through impact and pressure atomization inside the nozzle. The pressurized air passages extend along the axial direction, the air passages are narrow and elongated, and the outlet of the nozzle is provided with a multiplicity of round orifice structures. This patent mainly describes the structural features of the liquid passageways, the transverse passageways, the impingement pin and the expansion chamber inside the nozzle assembly. Chinese Patent Application No. 200580034838.1 discloses an improved internal mix air atomizing nozzle assembly. The nozzle assembly consists of a nozzle body, an air guide and impingement surfaces etc. Pressurized air is introduced into the nozzle to realize internal mixing of gas and liquid, the nozzle is provided therein with a gas-liquid two-phase flow impingement structure, and the outlet of the nozzle is provided with a multiplicity of round orifice structures. This patent mainly describes the structural features and functions of flow passages inside the nozzle assembly and the requirements on the ratio between flow passage areas.

Compared with the above two patents, the nozzle designed by the present invention adopts no external pressurized air source and no liquid impingement structure, air is drawn into the nozzle by means of the external atmospheric pressure and the liquid pressure drop resulting from the jet flow, a large number of spray droplets are formed through pressure atomization of the gas-liquid two-phase flow, the air passages and the liquid passages are perpendicular to each other, air flows along the radial direction of the liquid passages, the air passages are very short, the nozzle does not have an expansion chamber or an impingement structure therein, and the outlet of the nozzle is provided with only one conical orifice. Therefore, the nozzles provided by the above patents and the present invention are significantly different from each other in basic principles and structure. In addition, the present invention not only provides a structure of a gas-liquid two-phase flow atomizing nozzle, but also establishes a relational expression between parameters such as the volume median diameter $D_{0.5}$ of spray droplets of the nozzle, the designed spray flow rate Q and geometrical dimensions of the nozzle, provides design principles for the diameter $d_1$ of the nozzle core air inlet hole, the diameter $d_2$ of the atomizing-body outlet and the diameter $d_3$ of the sleeve air inlet hole, and provides design formulas of the diameter $D_1$ of the jet flow section, the length $L_1$ of the jet flow section, the diffusion angle β of the outlet diffusion section, the maximum inner diameter $D_2$ of the atomizing body mixing chamber and the width b of the air inlet buffering chamber, providing a reference for the control of droplet size and the structural design of the nozzle.

Chinese Patent Application No. 200580028231.2 discloses an air induction liquid spray nozzle assembly. The nozzle assembly mainly consists of a nozzle body and an insert. External air is drawn into the nozzle cavity through a venturi passage inside the insert, and the liquid inlet and the discharge orifice of the nozzle are eccentrically positioned. This patent mainly describes the shape of the liquid flow passage formed by the insert, the insert structure, and the engagement and mounting relationships between components. Chinese Patent Application No. 201410034361.8 discloses an internal mix two-phase flow nozzle. The nozzle consists of a nozzle body and a nozzle cap. Liquid and air are mixed in a tapered mixing area behind the liquid pipe, and the outlet of the nozzle is provided with a multiplicity of round orifice structures with small apertures. The nozzle can produce fine spray droplets at a high spray flow rate, thereby providing a good atomizing effect to facilitate the evaporation of the liquid.

Compared with the above two patents, the present invention provides a nozzle structure having central axisymmetric features. The liquid passages, the air passages, and the connecting part inside the nozzle are axisymmetric. Liquid and air are mixed at the jet flow section of the nozzle core. The outlet of the atomizing body is a conical orifice. The nozzle does not have a liquid impingement or impact component therein and has the characteristics of a small spray flow rate and a large droplet size. The design objective and structure of this nozzle are significantly different from those of the above patents. In addition, the present invention not only provides a structure of a gas-liquid two-phase flow atomizing nozzle, but also establishes a relational expression between parameters such as the volume median diameter $D_{0.5}$ of spray droplets of the nozzle, the designed spray flow rate Q and geometrical dimensions of the nozzle, provides design principles for the diameter $d_1$ of the nozzle core air inlet hole, the diameter $d_2$ of the atomizing-body outlet and the diameter $d_3$ of the sleeve air inlet hole, and provides design formulas of the diameter $D_1$ of the jet flow section, the length $L_1$ of the jet flow section, the diffusion angle β of the outlet diffusion section, the maximum inner diameter $D_2$ of the atomizing body mixing chamber and the width b of the air inlet buffering chamber, providing a reference for the control of droplet size and the structural design of the nozzle.

Chinese Patent Application No. 201510174084.5 discloses a two-phase flow atomizing air entrainment nozzle. The nozzle is mainly applied to the field of sprinkling irrigation, and mainly consists of a nozzle body, nozzle main part, an adjusting collar, a lock sleeve and a mixing nozzle. The nozzle body and the mixing nozzle are both gradually tapered. The air flow control is realized through the positions of the air adjusting holes on the adjusting collar and the air inlet holes on the nozzle. The control method is controlling the relative positions of the air adjusting holes and the air inlet holes during threaded mounting. This patent describes the structures of various components of the nozzle, the connection modes, and the method of calculating the orifice diameter.

Compared with the above patent, the two-phase flow atomizing nozzle provided by the present invention is mainly applied to the field of pesticide spraying and application using plant-protection machinery. The inner cavity of the nozzle provided by the present invention includes an inlet tapered section, a jet flow section, an outlet diffusion section and an atomizing body mixing chamber. The different parts of the inner cavity of the nozzle have different shapes and functions, the components of the nozzle are not connected by threaded connection, the shape of the inlet passage is fixed, and the amount of air intake is controlled by the shape and size of the air inlet passage, not by the mounting. The shape, structure, and connection mode of the inner cavity of the nozzle of the present invention are significantly different from those of the above patents. Different from the method of calculating the orifice diameter in the above patents, the present invention not only provides a structure of an atomizing nozzle, but also establishes a relational expression between parameters such as the volume median diameter $D_{0.5}$ of spray droplets of the nozzle, the designed spray flow rate Q and geometrical dimensions of the nozzle, provides design principles for the diameter $d_1$ of the nozzle core air inlet hole, the diameter $d_2$ of the atomizing-body outlet and the diameter $d_3$ of the sleeve air inlet hole, and provides design formulas of the diameter $D_1$ of the jet flow section, the length $L_1$ of the jet flow section, the diffusion angle β of the outlet diffusion section, the maximum inner diameter $D_2$ of the atomizing body mixing chamber and the width b of the air inlet buffering chamber, providing a reference for the control of droplet size and the structural design of the nozzle.

SUMMARY

To reduce a usage amount of chemical pesticide and improve an operating efficiency of plant-protection pesticide spraying and application machinery and a pesticide utilization rate, the present invention provides a gas-liquid two-phase flow atomizing nozzle. The gas-liquid two-phase flow atomizing nozzle designed by the present invention has the characteristics of a small spray flow rate and a large droplet size, and can effectively improve the pesticide adhesion and anti-drifting performance of the pesticide spraying and application operation while reducing the usage amount of pesticide, to ensure the effect of controlling pests and diseases, thereby achieving a better effect with less chemical pesticide. The present invention not only provides a structure of an atomizing nozzle, but also establishes a relational expression between parameters including the volume median diameter $D_{0.5}$ of spray droplets of the nozzle, the designed spray flow rate Q and geometrical dimensions of the nozzle, provides design principles for the diameter $d_1$ of the nozzle core air inlet hole, the diameter $d_2$ of the atomizing-body outlet and the diameter $d_3$ of the sleeve air inlet hole, and provides design formulas of the diameter $D_1$ of the jet flow section, the length $L_1$ of the jet flow section, the diffusion angle β of the outlet diffusion section, the maximum inner diameter $D_2$ of the atomizing body mixing chamber and the width b of the air inlet buffering chamber, providing a reference for the accurate control of droplet size and the structural design of the nozzle.

The technical solutions of the present invention are as follows.

1. A gas-liquid two-phase flow atomizing nozzle having an axisymmetric structure, includes a nozzle core, an outer sleeve and an atomizing body. An inner cavity of the nozzle core consists of an inlet tapered section, a jet flow section and an outlet diffusion section. The outlet diffusion section is in communication with an atomizing body mixing chamber. A nozzle core air inlet hole is provided on a wall surface of the nozzle core, and a sleeve air inlet hole is provided on a wall surface of the outer sleeve, so that the jet flow section in the inner cavity of the nozzle core is in communication with external atmosphere through the nozzle core air inlet hole, an air inlet buffering chamber and the sleeve air inlet hole. Liquid flows along a central axis of the nozzle, and is atomized after sequentially flowing through the inlet tapered section, the jet flow section, the outlet diffusion section, the atomizing body mixing chamber and an atomizing-body outlet. During the high-speed flow of the liquid in the jet flow section, hydrostatic pressure is significantly decreased until it is lower than the pressure of the external atmosphere. Thus, driven by the pressure of the external atmosphere, air enters the jet flow section through the sleeve air inlet hole, the air inlet buffering chamber and the nozzle core air inlet hole, and the liquid and air are mixed in the jet flow section, the outlet diffusion section and the atomizing body mixing chamber to generate a gas-liquid two-phase flow and produce droplets.

According to conditions such as the operational requirements of the nozzle and the liquid characteristics, first, values of a volume median diameter $D_{0.5}$ of spray droplets, a designed spray flow rate Q, a liquid density ρ, a liquid surface tension coefficient σ, a liquid dynamic viscosity μ and an air density $\rho_g$ of the nozzle under designed working conditions are determined. On the basis of the above parameter values determined, a diameter $d_1$ of the nozzle core air inlet hole, a diameter $d_2$ of the atomizing-body outlet and a diameter $d_3$ of the sleeve air inlet hole are specifically designed according to the following methods.

First, according to the requirements on the value of the volume median diameter $D_{0.5}$ of spray droplets of the nozzle, the values of the diameter $d_1$ of the nozzle core air inlet hole and the diameter $d_2$ of the atomizing-body outlet are determined, where the diameter $d_1$ of the nozzle core air inlet hole has a value range of $10D_{0.5}$-$15D_{0.5}$, the diameter $d_2$ of the atomizing-body outlet has a value range of $2D_{0.5}$-$5D_{0.5}$, and the value of the diameter $d_2$ of the atomizing-body outlet should satisfy the following constraint condition (1):

$$1.9\times10^4 \le \frac{\rho Q}{d_2\mu} \le 2.4\times10^4 \tag{1}$$

Wherein, Q is the designed spray flow rate of the nozzle, measured in $m^3/s$;

$d_2$ is the diameter of the atomizing-body outlet of the nozzle, measured in m;

ρ is the liquid density, measured in $Kg/m^3$; and

μ is the liquid dynamic viscosity, measured in Pa·s.

When the volume median diameter $D_{0.5}$ of spray droplets of the nozzle is ≥300 μm, $$\frac{\rho Q}{d_2\mu}$$

has a value range of $$1.9\times10^4 \le \frac{\rho Q}{d_2\mu} \le 2.1\times10^4;$$

when the volume median diameter $D_{0.5}$ of spray droplets of the nozzle is <300 μm, $$\frac{\rho Q}{d_2\mu}$$

has a value range of $$2.1\times10^4 \le \frac{\rho Q}{d_2\mu} \le 2.4\times10^4.$$

In addition to the values of the diameter $d_1$ of the nozzle core air inlet hole and the diameter $d_2$ of the atomizing-body outlet satisfying the above conditions, the diameter $d_1$ of the nozzle core air inlet hole, the diameter $d_2$ of the atomizing-body outlet and the diameter $d_3$ of the sleeve air inlet hole also should satisfy the following relational expression (2) and constraint condition (3):

$$D_{0.5} = d_2\left(1.92 - \frac{300\rho_g d_3}{\rho d_1}\right)\left[k_1 \ln\left(\frac{\rho_g Q^2}{d_2^3\sigma}\right) - 0.004\right] \quad (2)$$

$$2.2 \le \frac{N_2 d_3^2}{N_1 d_1^2} \le 6.5 \quad (3)$$

When the liquid dynamic viscosity μ is ≥0.001 Pa·s, the correction coefficient $k_1$ has a value range of $0.07 \le k_1 \le 0.10$; when the liquid dynamic viscosity μ is <0.001 Pa·s, the correction coefficient $k_1$ has a value range of $0.10 < k_1 \le 0.12$. A number $N_1$ of the nozzle core air inlet holes should be selected from a range specified below, and a number $N_2$ of the sleeve air inlet holes is designed and selected according to the constraint condition (3).

In the formulas, $D_{0.5}$ is the volume median diameter of spray droplets of the nozzle, measured in m;

- Q is the designed spray flow rate of the nozzle, measured in $m^3/s$;
- $d_1$ is the diameter of the nozzle core air inlet hole, measured in m;
- $d_2$ is the diameter of the atomizing-body outlet of the nozzle, measured in m;
- $d_3$ is the diameter of the sleeve air inlet hole, measured in m;
- ρ is the liquid density, measured in $Kg/m^3$;
- $\rho_g$ is the air density of the external atmospheric environment, measured in $Kg/m^3$;
- σ is the liquid surface tension coefficient, measured in N/m;
- $k_1$ is the correction coefficient, where $k_1$=0.07~0.12; and
- $N_1$ is the number of the nozzle core air inlet holes, where $N_1$=3~5;

2. The inner cavity of the nozzle core consists of the inlet tapered section, the jet flow section and the outlet diffusion section. Along a central axis of the nozzle core, the inlet tapered section gradually shrinks, the jet flow section is cylindrical, and the outlet diffusion section gradually expands. A series of the nozzle core air inlet holes circumferentially and evenly distributed are provided on a wall surface of the jet flow section, and the jet flow section of the inner cavity of the nozzle core is in communication with the air inlet buffering chamber through the nozzle core air inlet holes. In main geometrical dimension parameters of the nozzle core, design formulas of the diameter $D_1$ of the jet flow section, the length $L_1$ of the jet flow section and the diffusion angle β of the outlet diffusion section are as follows:

$$D_1 = \left(0.34\frac{\rho_g Q^2}{d_2^3\sigma} + 8.91\right)d_2$$

$$L_1 = 7d_1\left(\frac{1000\mu D_1}{\rho Q}\right)^{0.3}$$

$$\beta = 6^\circ \sim 10^\circ$$

where $D_1$ is the diameter of the jet flow section, measured in m;

- $\rho_g$ is the air density of the external atmospheric environment, measured in $Kg/m^3$;
- Q is the designed spray flow rate of the nozzle, measured in $m^3/s$;
- σ is the liquid surface tension coefficient, measured in N/m;
- $d_1$ is the diameter of the nozzle core air inlet hole, measured in m;
- $d_2$ is the diameter of the atomizing-body outlet of the nozzle, measured in m;
- $L_1$ is the length of the jet flow section, measured in m;
- ρ is the liquid density, measured in $Kg/m^3$;
- μ is the liquid dynamic viscosity, measured in Pa·s; and
- β is the diffusion angle of the outlet diffusion section, measured in °.

3. The nozzle core and the atomizing body are mounted inside the outer sleeve, and the air inlet buffering chamber is ring-shaped, and is located between an inner wall surface of the outer sleeve and an outer wall surface of the nozzle core. The atomizing body includes the atomizing body mixing chamber as an internal chamber thereof, the atomizing-body outlet is a conical orifice with a fixed diffusion angle, and an inner cavity of the atomizing body mixing chamber is conical-shaped. Along the flow direction of the gas-liquid two-phase flow, the inner diameter of the atomizing-body outlet increases linearly toward the outlet. The atomizing body and the nozzle core are mounted in an internal cavity of the outer sleeve. The atomizing body and the nozzle core are made of a ceramic, stainless steel or brass material. The outer sleeve is made of a nylon, polyethylene or polytetrafluoroethylene material. In main geometrical dimension parameters of the atomizing body, design formulas of the maximum inner diameter $D_2$ of the atomizing body mixing chamber and the width b of the air inlet buffering chamber are as follows:

$$D_2 = 2.6D_1 + L_1 \tan\beta$$

$$b = k_2 D_1$$

where when the liquid dynamic viscosity μ is ≥0.001 Pa·s, the correction coefficient $k_2$ has a value range of $0.6 \le k_2 \le 0.7$;

when the liquid dynamic viscosity μ is <0.001 Pa·s, the correction coefficient $k_2$ has a value range of $0.5 \le k_2 < 0.6$; and in the formulas, $D_2$ is the maximum inner diameter of the atomizing body mixing chamber, measured in m;

$D_1$ is the diameter of the jet flow section, measured in m;

$L_1$ is the length of the jet flow section, measured in m;

β is the diffusion angle of the outlet diffusion section, measured in °;

b is the width of the air inlet buffering chamber, measured in m; and $k_2$ is the correction coefficient, where $k_2$=0.5~0.7.

The beneficial effects of the present invention lie in that the gas-liquid two-phase flow atomizing nozzle designed according to the present invention has the characteristics of a small spray flow rate and a large droplet size, and using the nozzle to spray and apply a chemical pesticide can reduce the amount of pesticide applied, improve the adhesion property of the pesticide liquid, and reduce drifting, thereby achieving a better effect with less chemical pesticide. In addition, internal wear of the nozzle can be reduced, thereby effectively prolonging the service life of the nozzle.

BRIEF DESCRIPTION OF THE DRAWINGS

The present invention will be described in further detail below with reference to the accompanying drawings and the detailed description of embodiments, wherein.

DESCRIPTION OF THE EMBODIMENTS

Figure 1:
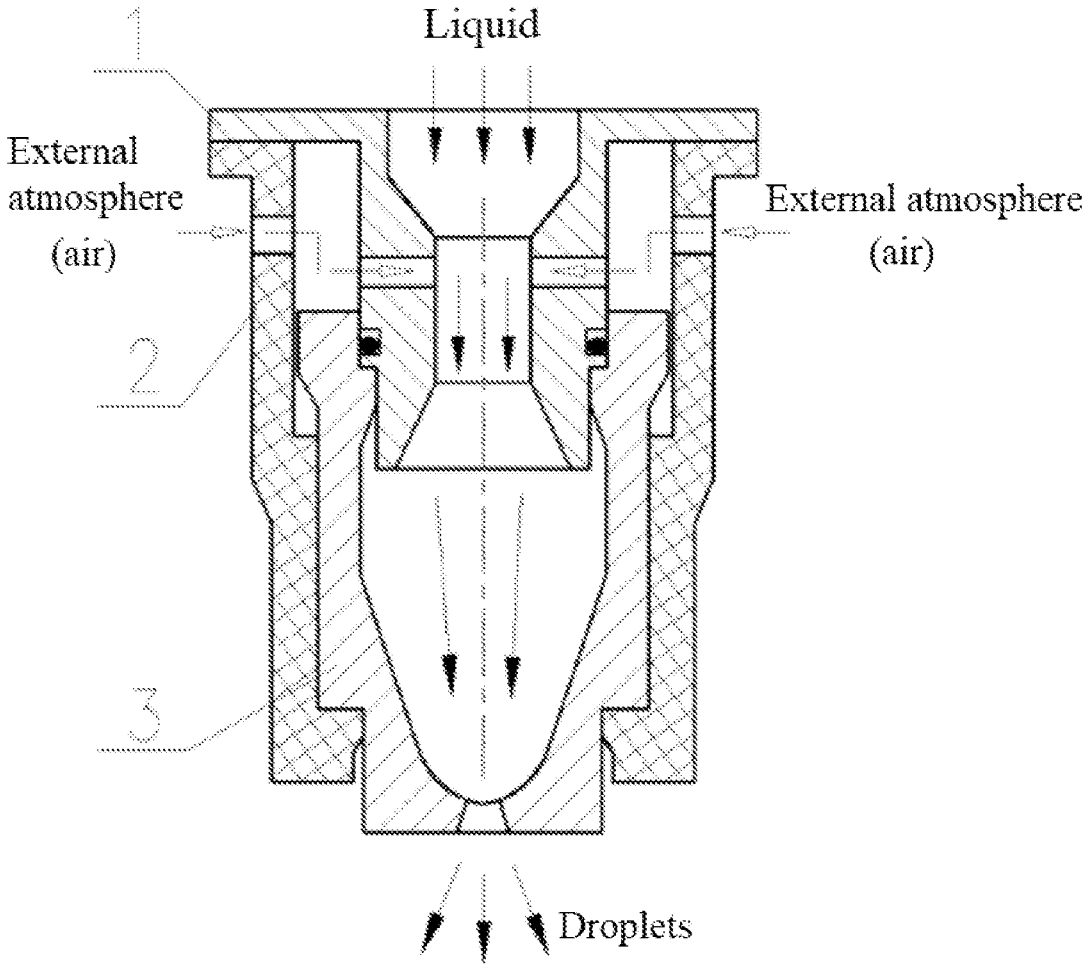
FIG. 1 is an axial plane cross-sectional view of a nozzle according to an embodiment of the present invention.
Figure 2:
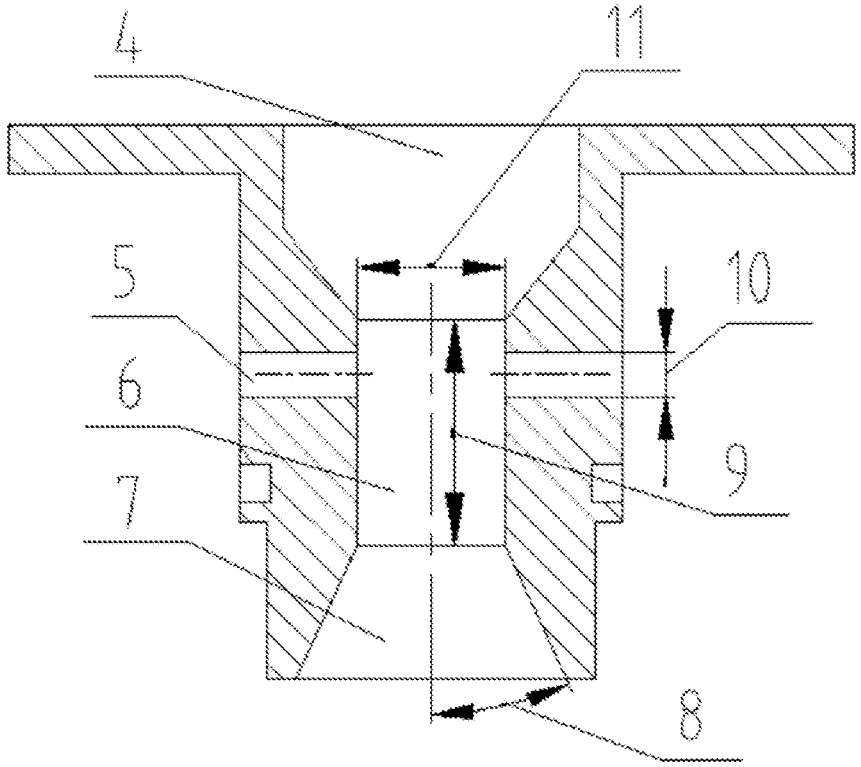
FIG. 2 is an axial plane cross-sectional view of a nozzle core according to the embodiment.
Figure 3:
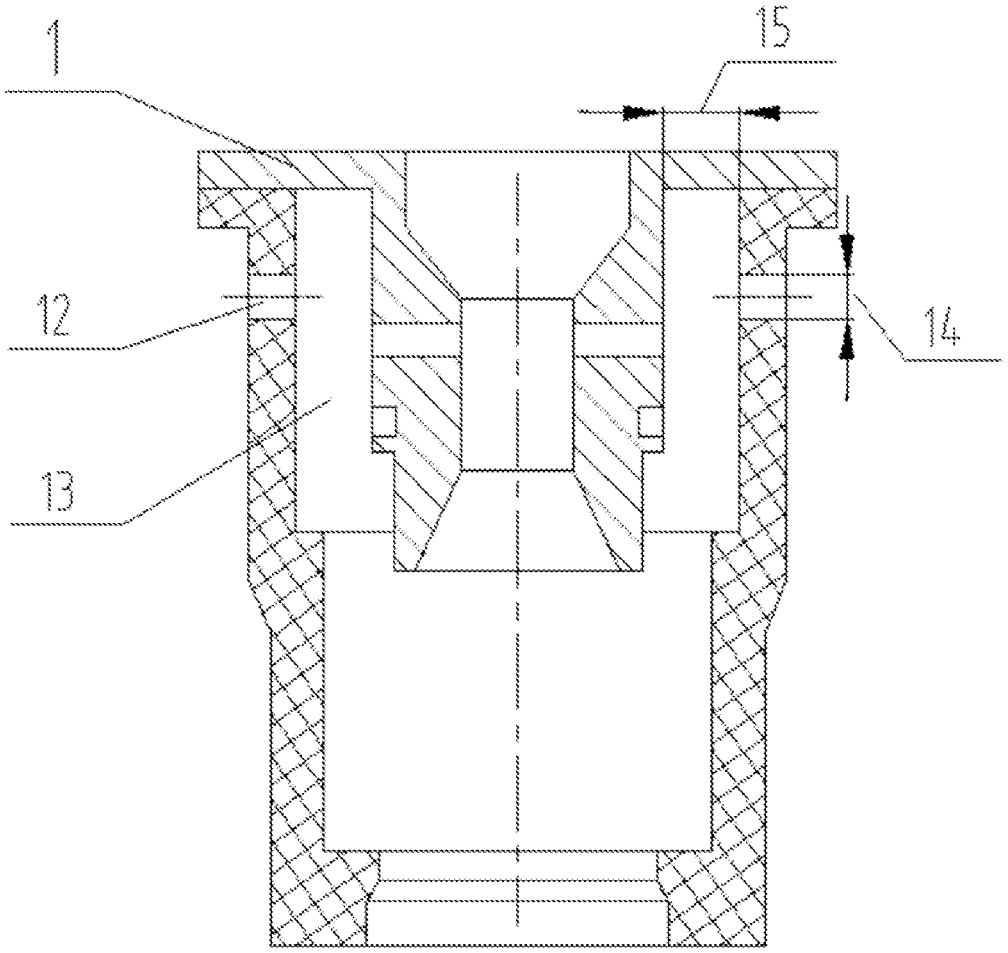
FIG. 3 is an axial plane cross-sectional view of the nozzle core and an outer sleeve assembled together according to the embodiment.
Figure 4:
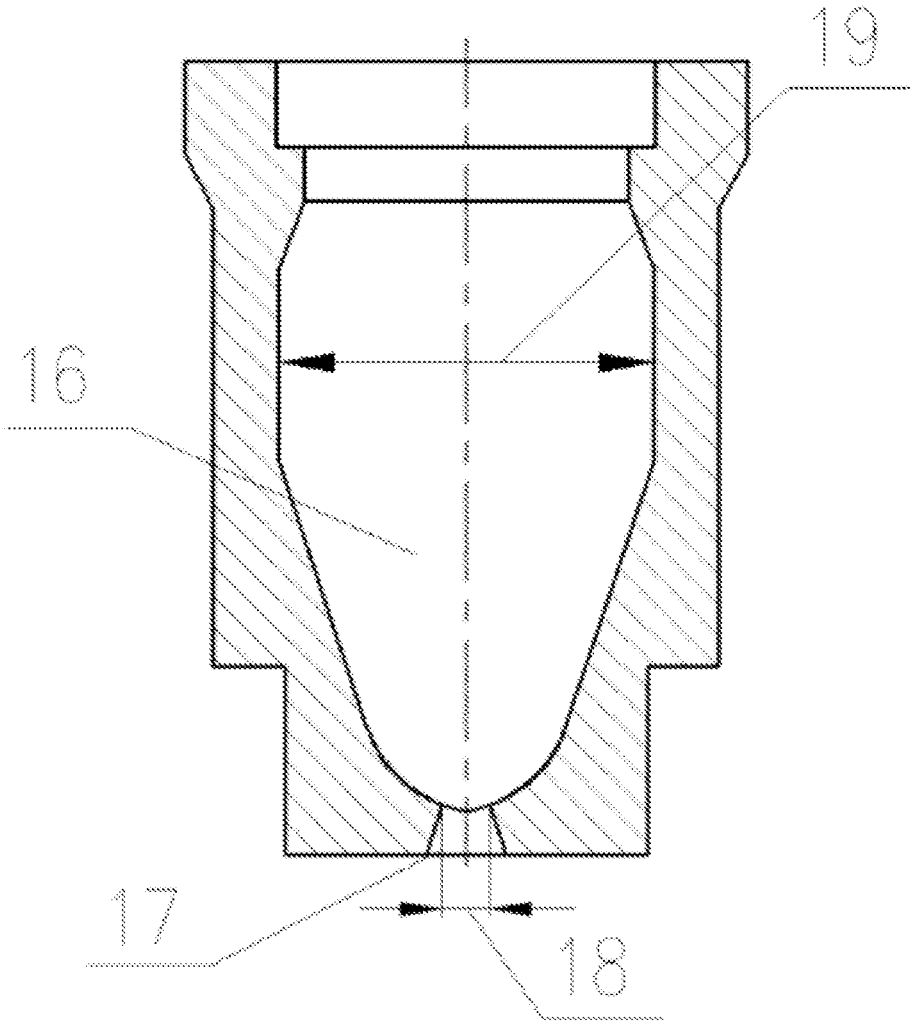
FIG. 4 is an axial plane cross-sectional view of an atomizing body according to the embodiment.

FIG. 1 to FIG. 4 together determine the structure and geometrical dimensions of a nozzle according to this embodiment, which is a gas-liquid two-phase flow atomizing nozzle having an axisymmetric structure, and includes a nozzle core 1, an outer sleeve 2, and an atomizing body 3. An inner cavity of the nozzle core 1 consists of an inlet tapered section 4, a jet flow section 6, and an outlet diffusion section 7. The outlet diffusion section 7 is in communication with an atomizing body mixing chamber 16. A nozzle core air inlet hole 5 and a sleeve air inlet hole 12 are respectively provided on a wall surface of the nozzle core 1 and a wall surface of the outer sleeve 2, so that the jet flow section 6 in the inner cavity of the nozzle core 1 is in communication with external atmosphere through the nozzle core air inlet hole 5, an air inlet buffering chamber 13, and the sleeve air inlet hole 12. Liquid flows along a central axis of the nozzle, and is atomized after sequentially flowing through the inlet tapered section 4, the jet flow section 6, the outlet diffusion section 7, the atomizing body mixing chamber 16, and an atomizing-body outlet 17. During the high-speed flow of the liquid in the jet flow section 6, hydrostatic pressure is significantly decreased until it is lower than the pressure of the external atmosphere. Thus, driven by the pressure of the external atmosphere, air enters the jet flow section 6 through the sleeve air inlet hole 12, the air inlet buffering chamber 13, and the nozzle core air inlet hole 5, and liquid and air are mixed in the jet flow section 6, the outlet diffusion section 7, and the atomizing body mixing chamber 16 to generate a gas-liquid two-phase flow and produce spray droplets.

According to conditions such as the operational requirements of the nozzle and the liquid characteristics, first, the values of a volume median diameter $D_{0.5}$ of spray droplets, a designed spray flow rate Q, a liquid density ρ, a liquid surface tension coefficient σ, a liquid dynamic viscosity μ and an air density $\rho_g$ of the nozzle under designed working conditions are determined. According to the technical requirements of the design of this embodiment, the volume median diameter $D_{0.5}$ of spray droplets is 0.0002 m=200 μm, the designed spray flow rate Q is $1.25\times10^{-5}$ $m^3/s$=0.75 L/min, the liquid density ρ is 1050 $Kg/m^3$, the liquid surface tension coefficient σ is 0.065 N/m, the liquid dynamic viscosity μ is 0.00095 Pa·s, and the air density $\rho_g$ is 1.2 $Kg/m^3$. On the basis of the parameter values determined, a diameter $d_1$ of the nozzle core air inlet hole, a diameter $d_2$ of the atomizing-body outlet and a diameter $d_3$ of the sleeve air inlet hole are specifically designed according to the following three steps.

First step. According to the requirements on the value of the volume median diameter $D_{0.5}$ of spray droplets of the nozzle, the values of the diameter $d_1$ of the nozzle core air inlet hole and the diameter $d_2$ of the atomizing-body outlet are determined first, where the diameter $d_1$ of the nozzle core air inlet hole has a value range of $10D_{0.5}$-$15D_{0.5}$ and is 0.002 m=$10D_{0.5}$ in this embodiment, the diameter $d_2$ of the atomizing-body outlet has a value range of $2D_{0.5}$-$5D_{0.5}$ and is 0.0006 m=$3D_{0.5}$ in this embodiment, and the value of the diameter $d_2$ of the atomizing-body outlet should satisfy the following constraint condition (1):

$$1.9\times10^4 \le \frac{\rho Q}{d_2\mu} \le 2.4\times10^4 \tag{1}$$

In the formula, Q is a designed spray flow rate of the nozzle, measured in $m^3/s$;

$d_2$ is the diameter of the atomizing-body outlet of the nozzle, measured in m;

ρ is the liquid density, measured in $Kg/m^3$; and

μ is the liquid dynamic viscosity, measured in Pa·s.

When the volume median diameter $D_{0.5}$ of spray droplets of the nozzle is ≥300 μm, $$\frac{\rho Q}{d_2\mu}$$

has a value range of $$1.9\times10^4 \le \frac{\rho Q}{d_2\mu} \le 2.1\times10^4;$$

when the volume median diameter $D_{0.5}$ of spray droplets of the nozzle is <300 μm, $$\frac{\rho Q}{d_2\mu}$$

has a value range of $$2.1\times10^4 < \frac{\rho Q}{d_2\mu} \le 2.4\times10^4.$$

By substituting the values such as the diameter $d_2$ of the atomizing-body outlet and the designed spray flow rate Q of this embodiment into the formula, it is obtained that $$\frac{\rho Q}{d_2\mu} \approx 23026,$$

which satisfies the requirement of $$2.1\times10^4 < \frac{\rho Q}{d_2\mu} \le 2.4\times10^4.$$

Second step. After the values of the diameter $d_1$ of the nozzle core air inlet hole and the diameter $d_2$ of the atomizing-body outlet are obtained, the parameters such as the volume median diameter $D_{0.5}$ of spray droplets, the designed spray flow rate Q, the diameter $d_1$ of the nozzle core air inlet hole and the diameter $d_2$ of the atomizing-body outlet are substituted into the relational expression (2), to obtain a value of the diameter $d_3$ of the sleeve air inlet hole that satisfies the relational expression (2).

$$D_{0.5} = d_2\left(1.92 - \frac{300\rho_g d_3}{\rho d_1}\right)\left[k_1 \ln\left(\frac{\rho_g Q^2}{d_2^3\sigma}\right) - 0.004\right] \quad (2)$$

When the liquid dynamic viscosity $\mu \ge 0.001$ Pa·s, the correction coefficient $k_1$ has a value range of $0.07 \le k_1 \le 0.10$; when the liquid dynamic viscosity $\mu < 0.001$ Pa·s, the correction coefficient $k_1$ has a value range of $0.10 \le k_1 \le 0.12$.

In the formulas, $D_{0.5}$ is the volume median diameter of spray droplets of the nozzle, measured in m;

Q is a designed spray flow rate of the nozzle, measured in $m^3/s$;

$d_1$ is the diameter of the nozzle core air inlet hole, measured in m;

$d_2$ is the diameter of the atomizing-body outlet of the nozzle, measured in m;

$d_3$ is the diameter of the sleeve air inlet hole, measured in m;

$\rho$ is the liquid density, measured in $Kg/m^3$;

$\rho_g$ is the air density of the external atmospheric environment, measured in $Kg/m^3$;

$\sigma$ is the liquid surface tension coefficient, measured in N/m; and $k_1$ is a correction coefficient, where $k_1$=0.07~0.12.

According to the above requirements, the parameters of this embodiment such as the diameter $d_1$ of the nozzle core air inlet hole, the diameter $d_2$ of the atomizing-body outlet, the volume median diameter $D_{0.5}$ of spray droplets, the designed spray flow rate Q, the diameter $d_1$ of the nozzle core air inlet hole and the diameter $d_2$ of the atomizing-body outlet are substituted into the relational expression, to obtain a value of the diameter $d_3$ of the sleeve air inlet hole that satisfies the relational expression (2), where the value is 0.0043 m, and $k_1$=0.11.

Third step. The diameter $d_1$ of the nozzle core air inlet hole and the diameter $d_3$ of the sleeve air inlet hole obtained in the first step and the second step are substituted into a constraint condition (3), to determine specific values of the number $N_1$ of nozzle core air inlet holes and the number $N_2$ of sleeve air inlet holes. The number $N_1$ of nozzle core air inlet holes should be selected from a specified range, and the number $N_2$ of sleeve air inlet holes is designed and selected according to the constraint condition (3).

$$2.2 \leqslant \frac{N_2 d_3^2}{N_1 d_1^2} \leqslant 6.5 \quad (3)$$

Wherein, $d_1$ is the diameter of the nozzle core air inlet hole, measured in m;

$d_3$ is the diameter of the sleeve air inlet hole, measured in m; and $N_1$ is the number of nozzle core air inlet holes, where $N_1$=3~5.

According to the requirement of the constraint condition (3), by substituting the values of the diameter $d_1$ of the nozzle core air inlet hole and the diameter $d_3$ of the sleeve air inlet hole of this embodiment and letting the number $N_1$ of nozzle core air inlet holes be 3, it is obtained through calculation that the number $N_2$ of sleeve air inlet holes is 6, and $$\frac{N_2 d_3^2}{N_1 d_1^2} = 3.06,$$

which satisfies the requirement of the constraint condition (3).

The inner cavity of the nozzle core 1 consists of the inlet tapered section 4, the jet flow section 6, and the outlet diffusion section 7. Along a central axis of the nozzle core 1, the inlet tapered section 4 gradually shrinks, the jet flow section 6 is cylindrical, and the outlet diffusion section 7 gradually expands. A series of the nozzle core air inlet holes 5 circumferentially and evenly distributed are provided on a wall surface of the jet flow section 6, and the jet flow section 6 of the inner cavity of the nozzle core 1 is in communication with the air inlet buffering chamber 13 through the nozzle core air inlet holes 5. In main geometrical dimension parameters of the nozzle core 1, design formulas of the diameter $D_1$ 11 of the jet flow section, the length $L_1$ 9 of the jet flow section and the diffusion angle $\beta$ 8 of the outlet diffusion section are as shown in formulas (4), (5) and (6):

$$D_1 = \left(0.34\frac{\rho_g Q^2}{d_2^3\sigma} + 8.91\right)d_2 \quad (4)$$

$$L_1 = 7d_1\left(\frac{1000\mu D_1}{\rho Q}\right)^{0.3} \quad (5)$$

$$\beta = 6^\circ \sim 10^\circ \quad (6)$$

Wherein, $D_1$ is the diameter of the jet flow section, measured in m;

$\rho_g$ is the air density of the external atmospheric environment, measured in $Kg/m^3$;

Q is a designed spray flow rate of the nozzle, measured in $m^3/s$;

$\sigma$ is the liquid surface tension coefficient, measured in N/m;

$d_1$ is the diameter of the nozzle core air inlet hole, measured in m;

$d_2$ is the diameter of the atomizing-body outlet of the nozzle, measured in m;

$L_1$ is the length of the jet flow section, measured in m;

$\rho$ is the liquid density, measured in $Kg/m^3$;

$\mu$ is the liquid dynamic viscosity, measured in Pa·s; and $\beta$ is the diffusion angle of the outlet diffusion section, measured in °.

By substituting the above values into the formulas (4), (5) and (6) to calculate the values such as the diameter $D_1$ 11 of the jet flow section of this embodiment, it is obtained that the value of the diameter $D_1$ 11 of the jet flow section is 0.008 m, the value of the length $L_1$ 9 of the jet flow section is 0.012, and the diffusion angle $\beta$ 8 of the outlet diffusion section is 6°.

The nozzle core 1 and the atomizing body 3 are mounted inside the outer sleeve 2, and the air inlet buffering chamber 13 is ring-shaped and located between an inner wall surface of the outer sleeve 2 and an outer wall surface of the nozzle core 1. The atomizing body 3 includes the atomizing body mixing chamber 16 as an internal chamber thereof, the atomizing-body outlet 17 is a conical orifice with a fixed diffusion angle, and an inner cavity of the atomizing body mixing chamber 16 is conical-shaped. Along the flow direction of the gas-liquid two-phase flow, the inner diameter of the atomizing-body outlet 17 increases linearly toward the outlet. The atomizing body 3 and the nozzle core 1 are mounted in an internal cavity of the outer sleeve 2. The atomizing body 3 and the nozzle core 1 are made of a ceramic, stainless steel or brass material. The outer sleeve 2 is made of a nylon, polyethylene or polytetrafluoroethylene material. In main geometrical dimension parameters of the atomizing body 3, design formulas of the maximum inner diameter $D_2$ 19 of the atomizing body mixing chamber and the width b 15 of the air inlet buffering chamber are as shown in formulas (7) and (8).

$$D_2=2.6D_1+L_1 \tan \beta \quad (7)$$

$$b=k_2D_1 \quad (8)$$

When the liquid dynamic viscosity $\mu \geq 0.001$ Pa·s, the correction coefficient $k_2$ has a value range of $0.6 \leq k_2 \leq 0.7$; when the liquid dynamic viscosity $\mu < 0.001$ Pa·s, the correction coefficient $k_2$ has a value range of $0.5 \leq k_2 \leq 0.6$.

In the formulas, $D_2$ is the maximum inner diameter of the atomizing body mixing chamber, measured in m;

$D_1$ is the diameter of the jet flow section, measured in m;

$L_1$ is the length of the jet flow section, measured in m;

$\beta$ is the diffusion angle of the outlet diffusion section, measured in °;

b is the width of the air inlet buffering chamber, measured in m; and $k_2$ is a correction coefficient, where $k_2$=0.5-0.7.

By substituting the above values into the formulas (7) and (8) to calculate the values of the maximum inner diameter $D_2$ 19 of the atomizing body mixing chamber and the width b 15 of the air inlet buffering chamber of this embodiment, it is obtained that the value of the maximum inner diameter $D_2$ 19 of the atomizing body mixing chamber is 0.022 m, and the width b 15 of the air inlet buffering chamber is 0.0045, where $k_2$=0.55.

According to the above design and calculation process, the structure and key geometrical dimensions of the nozzle according to this embodiment of the present invention can be obtained. Samples were fabricated and tested based on this embodiment of the present invention. Test data of this embodiment of the present invention was compared with performance data of a conventional single-phase flow atomizing nozzle. The specific results are as shown in the following table.

TABLE 1

Comparison of performance data of the embodiment of the present invention and a conventional nozzle

| Nozzle type | Volume median diameter $D_{0.5}$ of spray droplets (μm) | Spray flow rate Q (L/min) | Spray pressure (MPa) |
|---|---|---|---|
| Embodiment of the present invention | 208 | 0.61 | 0.2 MPa |
| | 203 | 0.75 | 0.25 MPa |
| | 194 | 0.85 | 0.3 MPa |
| Conventional single-phase fluid atomizing nozzle | 135 | 0.92 | 0.2 MPa |
| | 124 | 1.15 | 0.25 MPa |
| | 116 | 1.29 | 0.3 MPa |

As shown in Table 1, when the spray pressure is 0.2 MPa to 0.3 MPa, the performance of the nozzle of this embodiment of the present invention can satisfy to a certain degree the specific requirements on the design parameters such as the volume median diameter $D_{0.5}$ of spray droplets and the designed spray flow rate Q. Compared with the conventional single-phase flow atomizing nozzle, the nozzle of this embodiment of the present invention obviously has the characteristics of a small spray flow rate and a large droplet size, and under the same spray pressure, the droplet size is generally increased by about 60% than that of the conventional nozzle, and the spray flow rate is decreased by about 35%. Therefore, the nozzle of this embodiment of the present invention is particularly applicable to the technical field of low-amount pesticide spraying and application for plant protection in orchards and facility agriculture.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A gas-liquid two-phase flow atomizing nozzle, comprising: a nozzle core, an outer sleeve, and an atomizing body, wherein an inner cavity of the nozzle core consists of an inlet tapered section, a jet flow section, and an outlet diffusion section; along a central axis of the nozzle core, the inlet tapered section gradually shrinks, the jet flow section is cylindrical, and the outlet diffusion section gradually expands, and the outlet diffusion section is in direct communication with an atomizing body mixing chamber; a series of nozzle core air inlet holes is provided on a wall surface of the nozzle core, a plurality of sleeve air inlet holes is provided on a wall surface of the outer sleeve, so that the jet flow section in the inner cavity of the nozzle core is in communication with external atmosphere through the nozzle core air inlet holes, an air inlet buffering chamber and the sleeve air inlet holes; liquid flows along a central axis of the nozzle, and is atomized after sequentially flowing through the inlet tapered section, the jet flow section, the outlet diffusion section, the atomizing body mixing chamber, and an atomizing-body outlet, air from the external atmosphere enters the jet flow section through the sleeve air inlet holes, the air inlet buffering chamber, and the nozzle core air inlet holes, and the liquid and the air are mixed in the jet flow section, the outlet diffusion section, and the atomizing body mixing chamber; the nozzle core air inlet holes circumferentially and evenly distributed are provided on a wall surface of the jet flow section, and the jet flow section of the inner cavity of the nozzle core is in communication with the air inlet buffering chamber through the nozzle core air inlet holes; the nozzle core and the atomizing body are mounted inside the outer sleeve, and the air inlet buffering chamber is ring-shaped and is located between an innerwall surface of the outer sleeve and an outer wall surface of the nozzle core; the atomizing body comprises the atomizing body mixing chamber as an internal chamber thereof, the atomizing-body outlet is a conical orifice with a fixed diffusion angle, and an inner cavity of the atomizing body mixing chamber is conical-shaped; the atomizing body and the nozzle core are mounted in an internal cavity of the outer sleeve, the atomizing body and the nozzle core are made of a ceramic, stainless steel or brass material, and the outer sleeve is made of a nylon, polyethylene or polytetrafluoroehylene material;

parameters including a volume median diameter $D_{0.5}$ of spray droplets that the nozzle is configured to spray, a designed flow rate Q of the nozzle and geometrical dimensions of parts of the nozzle satisfy the following relationship:

$$D_{0.5} = d_2\left(1.92 - \frac{300\rho_g d_3}{\rho d_1}\right)\left[k_1 \ln\left(\frac{\rho_g Q^2}{d_2^3\sigma}\right) - 0.004\right]$$

and the following constraint conditions:

$$1.9\times10^4 \le \frac{\rho Q}{d_2\mu} \le 2.4\times10^4$$

$$2.2 \le \frac{N_2 d_3^2}{N_1 d_1^2} \le 6.5$$

when the volume median diameter $D_{0.5}$ of spray droplets of the nozzle is ≥300 μm, $$\frac{\rho Q}{d_2\mu}$$

has a value range of $$1.9\times10^4 \le \frac{\rho Q}{d_2\mu} \le 2.1\times10^4;$$

when the volume median diameter $D_{0.5}$ of spray droplets of the nozzle is <300 μm, $$\frac{\rho Q}{d_2\mu}$$

has a value range of $$2.1\times10^4 \le \frac{\rho Q}{d_2\mu} \le 2.4\times10^4;$$

when a liquid dynamic viscosity μ is ≥0.001 Pa·s, a correction coefficient $k_1$ has a value range of $0.07 \le k_1 \le 0.10$;

when the liquid dynamic viscosity μ is <0.001 Pa·s, the correction coefficient $k_1$ has a value range of $0.10 < k_1 \le 0.12$; and in the formulas, $D_{0.5}$ is the volume median diameter of spray droplets of the nozzle, measured in m;

Q is the designed flow rate of the nozzle, measured in $m^3/s$;

$d_1$ is a diameter of the nozzle core air inlet holes, measured in m;

$d_2$ is a diameter of the atomizing-body outlet of the nozzle, measured in m;

$d_3$ is a diameter of the sleeve air inlet holes, measured in m;

ρ is a liquid density, measured in $Kg/m^3$;

$\rho_g$ is an air density of the external atmospheric environment, measured in $Kg/m^3$;

σ is a liquid surface tension coefficient, measured in N/m;

μ is the liquid dynamic viscosity, measured in Pa·s;

$k_1$ is the correction coefficient, wherein $k_1$=0.07~0.12;

$N_1$ is a number of the nozzle core air inlet holes, wherein $N_1$=3~5, and $N_2$ is a number of the sleeve air inlet holes.

2. The gas-liquid two-phase flow atomizing nozzle according to claim 1, wherein in geometrical dimension parameters of the nozzle core, a diameter $D_1$ of the jet flow section, a length $L_1$ of the jet flow section, and a diffusion angle β of the outlet diffusion section satisfy the following relationship:

$$D_1 = \left(0.34\frac{\rho_g Q^2}{d_2^3\sigma} + 8.91\right)d_2$$

$$L_1 = 7d_1\left(\frac{1000\mu D_1}{\rho Q}\right)^{0.3}$$

$$\beta = 6^\circ \sim 10^\circ$$

wherein, $D_1$ is the diameter of the jet flow section, measured in m;

$\rho_g$ is the air density of the external atmospheric environment, measured in $Kg/m^3$;

Q is the designed flow rate of the nozzle, measured in $m^3/s$;

σ is the liquid surface tension coefficient, measured in N/m;

$d_2$ is the diameter of the atomizing-body outlet of the nozzle, measured in m;

$L_1$ is the length of the jet flow section, measured in m;

ρ is the liquid density, measured in $Kg/m^3$;

μ is the liquid dynamic viscosity, measured in Pa·s; and

β is the diffusion angle of the outlet diffusion section, measured in °.

3. The gas-liquid two-phase flow atomizing nozzle according to claim 1, wherein in geometrical dimension parameters of the atomizing body, a maximum inner diameter $D_2$ of the atomizing body mixing chamber and a width b of the air inlet buffering chamber satisfy the following relationship:

$$D_2 = 2.6D_1 + L_1 \tan\beta$$

$$b = k_2 D_1$$

wherein when a liquid dynamic viscosity μ is ≥0.001 Pa·s, a correction coefficient $k_2$ has a value range of $0.6 \leq k_2 \leq 0.7$; when the liquid dynamic viscosity μ is <0.001 Pa·s, the correction coefficient $k_2$ has a value range of $0.5 \leq k < 0.6$; and in the formulas, $D_2$ is the maximum inner diameter of the atomizing body mixing chamber, measured in m;

$D_1$ is a diameter of the jet flow section, measured in m;

$L_1$ is a length of the jet flow section, measured in m;

β is a diffusion angle of the outlet diffusion section, measured in °;

b is the width of the air inlet buffering chamber, measured in m; and $k_2$ is the correction coefficient, wherein $k_2$=0.5~0.7.

* * * * *